US006655932B1

(12) United States Patent
Stinessen et al.

(10) Patent No.: US 6,655,932 B1
(45) Date of Patent: Dec. 2, 2003

(54) PRESSURE IMPACTED COOLING AND LUBRICATION UNIT

(75) Inventors: Kjell Olav Stinessen, Tranby (NO); Brede Thorkildsen, Solbergelva (NO)

(73) Assignee: Kvaerner Eureka AS, Tranby (NO)

( * ) Notice: Subject to any disclaimer, the term of this patent is extended or adjusted under 35 U.S.C. 154(b) by 0 days.

(21) Appl. No.: 09/980,015

(22) PCT Filed: May 30, 2000

(86) PCT No.: PCT/NO00/00183

§ 371 (c)(1),
(2), (4) Date: Mar. 7, 2002

(87) PCT Pub. No.: WO00/73621

PCT Pub. Date: Dec. 7, 2000

(30) Foreign Application Priority Data

Jun. 1, 1999 (NO) ..... 992627

(51) Int. Cl.[7] ..... F04B 17/03

(52) U.S. Cl. ..... 417/423.1; 417/778; 417/373; 417/423.8; 417/423.5; 310/84

(58) Field of Search ..... 417/228, 373, 417/372, 423.1, 423.3, 423.8, 423.5, 423.11; 310/84

(56) References Cited

U.S. PATENT DOCUMENTS 4,460,181 A 7/1984 Araoka ..... 277/12
4,614,482 A * 9/1986 Gaffal ..... 417/367
5,336,064 A 8/1994 Lamers ..... 417/423.3
5,795,135 A * 8/1998 Nyilas et al. ..... 417/53
5,957,667 A * 9/1999 Epp ..... 417/271
6,086,331 A * 7/2000 Halkj.ae butted.r ..... 417/9
6,121,698 A * 9/2000 Sexton ..... 310/54
6,379,127 B1 * 4/2002 Andrews et al. ..... 417/423.11
6,422,822 B1 * 7/2002 Holmes ..... 417/9

FOREIGN PATENT DOCUMENTS

WO WO 97/21055 6/1997

* cited by examiner

*Primary Examiner*—Cheryl J. Tyler
*Assistant Examiner*—Emmanuel Sayoc
(74) *Attorney, Agent, or Firm*—Young & Thompson

(57) ABSTRACT

A device for cooling and lubricating a subsea device (1) which includes an electric rotary machine (4) and a fluid-rotation machine (6-8) drive-connected (5) thereto, which electric rotary machine (4) has a lubrication/cooling circuit includes a cooler (11) exposed towards the surrounding seawater, and where the fluid-rotation machine (6-8) has a fluid pressure at the end facing towards the electric rotary machine (4). The lubrication/cooling circuit (12, 11, 14) is pressure-impacted by the fluid pressure at one point (19, 20) in the lubrication/cooling circuit outside the fluid-rotation machine (6-8).

14 Claims, 6 Drawing Sheets

PRESSURE IMPACTED COOLING AND LUBRICATION UNIT

BACKGROUND OF THE INVENTION

The invention relates to a device for use with a subsea pump module which includes a housing, a pump disposed in the housing and having a pump inlet and a pump outlet, a pump shaft with mechanical seals and bearings for supporting the pump shaft in the housing, an electric pump motor arranged in the housing and having a motor shaft drive-connected to the pump shaft, which pump module has a pump motor lubrication/cooling circuit (a lubrication and coding circuit) exposed to the surrounding seawater and where the said pump inlet is at the side of the pump that is adjacent to the pump motor.

DESCRIPTION OF THE RELATED ART

One of the requirements for subsea devices, such as a subsea pump module as mentioned, is that they should have a useful life of maximum length and with full functioning ability, even after they have been out of service for longer or shorter periods of time. In this connection, the integrity and functioning ability of the lubrication and cooling circuit will be of vital importance.

Clearly, therefore, there is a need for a subsea device of the said type that is reliable and has a long operative useful life.

SUMMARY OF THE INVENTION

Accordingly, it is an object of the present invention to provide a device for cooling and lubricating a subsea pump module as mentioned, and a specific object of the invention is to provide barriers and pressure differences relative to the fluid pressure in the pump in order thereby to ensure that any leaks are in the direction of the pump. In this way, in the case of a subsea pump module, the pump medium is prevented from contaminating the lubricant and coolant.

Another specific object of the invention is to provide a device for cooling and lubricating a subsea pump module in the form of an autonomous passive lubrication and cooling system without the need for external control systems or instrumentation under normal operating conditions, apart from condition monitoring which requires instrumentation, and means for refilling lubricant/coolant.

According to the invention, a device is proposed for use with a subsea pump module which includes a housing, a pump disposed in the housing and having a pump inlet and a pump outlet, a pump shaft with mechanical seals and bearings for supporting the pump shaft in the housing, an electric pump motor arranged in the housing and having a motor shaft drive-connected to the pump shaft, which pump module has a pump motor lubrication/cooling circuit exposed to the surrounding seawater, and where the said pump inlet is at the side of the pump that is adjacent to the pump motor, characterised in that the lubrication/cooling circuit is pressure-impacted by the pump medium pressure in front of the pump inlet via a separating means pretensioned towards the pump motor, and that an impeller is arranged on the pump shaft at the end adjacent to the pump inlet.

In this way a favourable balance of pressure is obtained, and by means of a suitable layout of the lubrication-cooling circuit with an impeller drive-connected to the electric motor there can advantageously be obtained a certain overpressure in the lubrication/cooling circuit towards the pump across the mechanical seals. It is especially advantageous, according to the invention, for the lubrication/cooling circuit to be pressure-impacted by said medium pressure via a separating diaphragm.

A separating diaphragm of this kind will provide a physical separation of the lubricant/coolant and the pump medium at the external point of pressure application.

It is particularly advantageous to provide/increase the said pressure application using a weight load which acts in the direction of the lubrication/cooling circuit.

A weight load of this kind will ensure/provide an overpressure in the lubrication/cooling circuit relative to the medium pressure.

It is particularly advantageous for the weight load to be in the form of a liquid column.

A heavy liquid column of this kind can be provided in a simple manner by using a heavy, preferably inert liquid.

A particularly favourable embodiment according to the invention is one where the liquid column is provided between an upper and a lower separating diaphragm.

In this way a double barrier is obtained.

It is especially advantageous for each individual separating diaphragm to be provided with a damper piston.

In one practical embodiment, the damper piston has a control rod attached thereto which passes through a seal that will interact with the damper piston if and when the diaphragm and thus the damper piston move towards an end position upon loss of volume in the separating diaphragm means. The use of a damper piston of this kind will protect the diaphragm in the event of such loss of volume.

In another embodiment according to the invention, the liquid column may be separated from the said medium and from the lubricant/coolant in the lubrication/cooling circuit by a respective float valve. In this connection, it is particularly advantageous to split the liquid column into two liquid columns which are separated from one another by a lubricant/coolant column, which is bounded at one of the liquid columns by a float valve.

It is especially advantageous to provide a seal lubrication circuit for the pump.

This seal lubrication circuit can advantageously be connected to the lubrication/cooling is circuit in such manner that the seal lubrication circuit has a pressure that is lower than that of the lubrication/cooling circuit, but higher than the said medium pressure.

A particularly favourable embodiment is one where the seal lubrication circuit is connected to the lubrication/cooling circuit via a separator for separating water from the lubricant/coolant, the separator being connected to the lubrication/cooling circuit at some point in the cooler.

A design of this kind allows a slight suction pressure to be obtained in the direction of the seal lubrication circuit, so that it is automatically refilled from the lubrication/cooling circuit via the separator.

In one embodiment, the seal lubrication circuit can be connected to the lubrication/cooling circuit via a separating diaphragm that is weight-loaded towards the lubrication/cooling circuit.

According to the invention, when separating diaphragms are used, each individual separating diaphragm can advantageously be associated with an external level sensor.

It is especially advantageous for the lubrication/cooling circuit to include an impeller in the electric motor.

BRIEF DESCRIPTION OF THE DRAWINGS

The invention will now be explained in more detail with reference to the drawings, wherein.

DESCRIPTION OF THE PREFERRED EMBODIMENT

Figure 1:
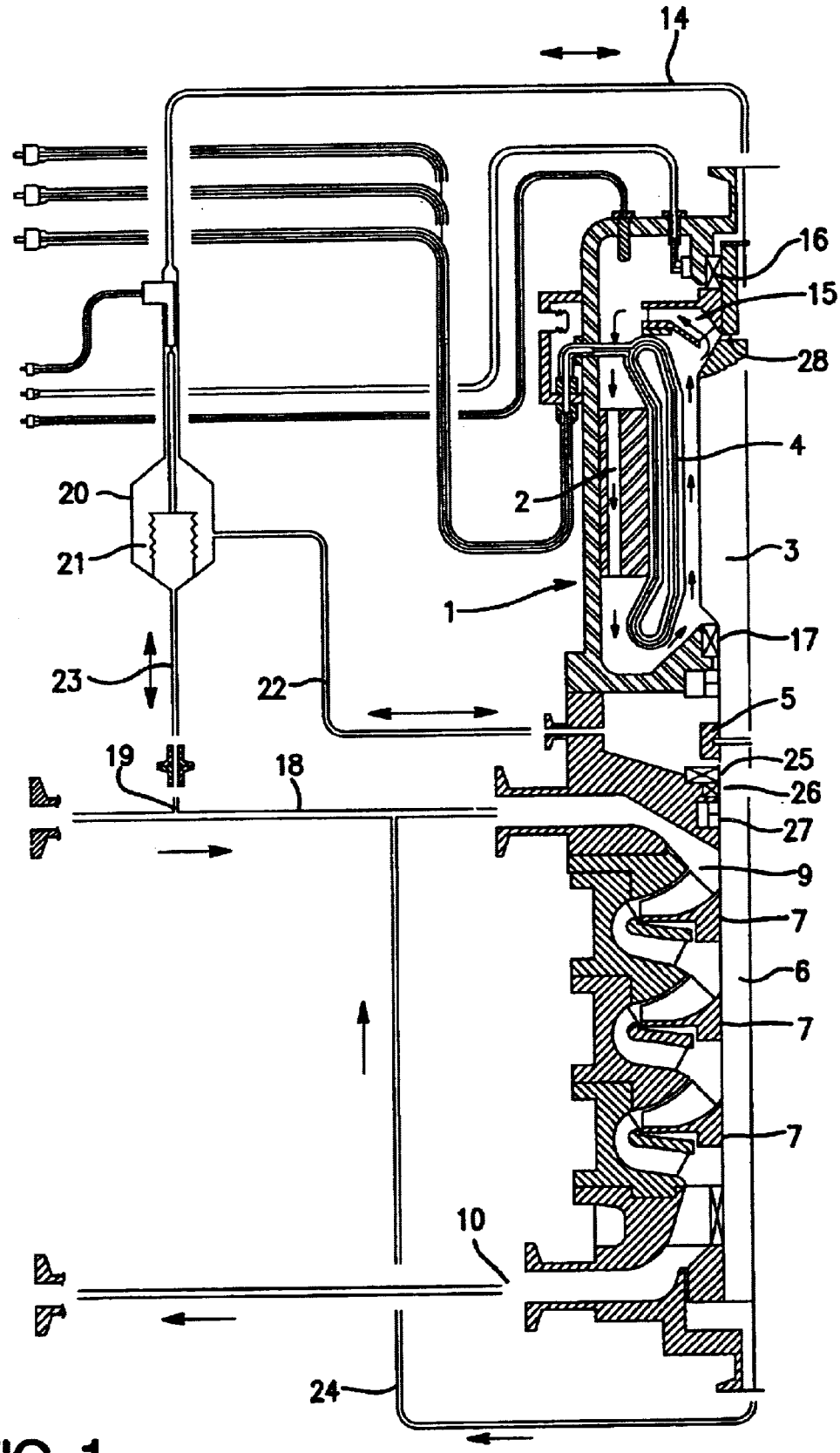
FIG. 1 is a purely schematic cross-sectional view of a subsea pump module having a device according to the invention.

The pump module 1 shown in FIG. 1 has a pump and pump motor in a common pressure shell. The pump motor 4 is an electric motor having a motor shaft 3, which by means of a flexible connection 5 is drive-connected to a pump shaft 6, which carries three pump impellers 7. The pump inlet is indicated by means of the reference numeral 9 and the pump outlet is indicated by means of the reference numeral 10. The bearings for the motor shaft 3 are indicated by means of reference numerals 16 and 17.

A lubrication/cooling circuit 2 is provided for the electric motor and includes a lubricant/coolant impeller 15 on the motor shaft 3. The motor space, where the coolant circulates (the actual motor housing acts as a cooler) is, via a transverse drilled hole 28 in the motor shaft 3, connected to a line 14 which runs to a diaphragm housing 20, where there is indicated a separating diaphragm 21, so that the diaphragm housing 20 is divided into two chambers. The separating diaphragm 21 is pretensioned in the direction of the line 14, i.e., towards the electric motor 4. In FIG. 1 the upper chamber is connection by a line 22 to the space around the flexible connection 5, for pressure balancing.

The lubrication circuit 2 is connected to the pump inlet line 18 at 19 via the diaphragm housing 20 by line 23, which opens into the lower chamber in the diaphragm housing 20, i.e., in this case inside the diaphragm/bellows 21.

A balance line 24 runs from the high-pressure end of the pump to the inlet line 18.

Via the separating diaphragm 21, the lubrication/cooling circuit will be pressure-impacted by the fluid pressure at the inlet of the pump. The pressure application via the separating diaphragm ensures a balancing of pressure, with a small pressure difference from the motor towards the pump via the bearings 25, 26 and a mechanical seal 27. The pressure difference arises because the pressure falls in the pump inlet 9 relative to the pressure at 19 when the pump is running, and because there is an impeller function (not shown in any detail) in/at the seal 27.

Figure 2:
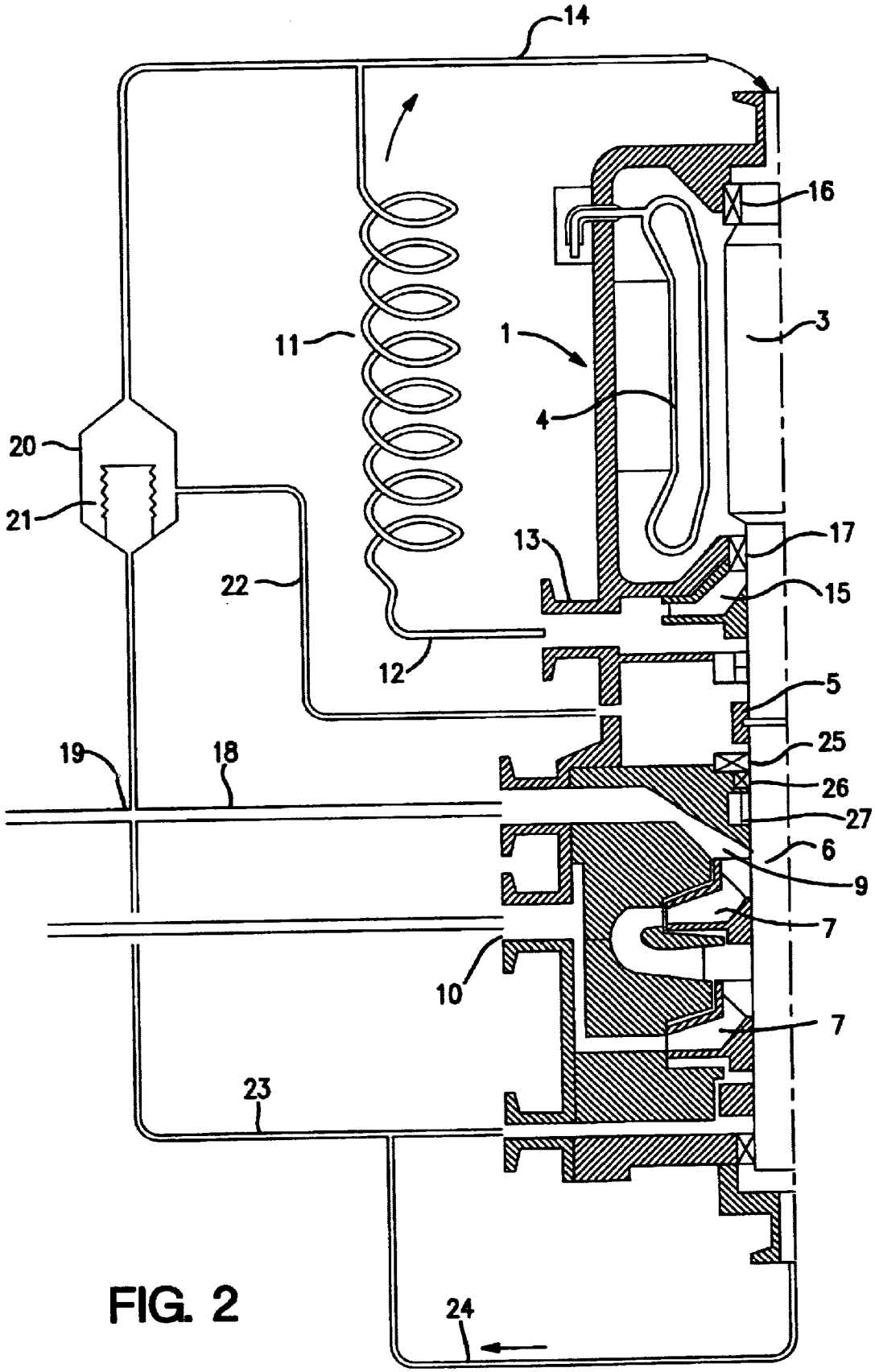
FIG. 2 is a purely schematic cross-sectional view of a subsea pump module according to the invention.

The system shown in FIG. 2 differs from the embodiment in FIG. 1 primarily in that an external cooler 11 is used. The same reference numerals are therefore used for corresponding parts.

The pump module 1 shown in FIG. 2 has a pump and a pump motor in a common pressure shell. The pump motor 4 is an electric motor having a motor shaft 3, which by means of a flexible connection 5 is drive-connected to a pump shaft 6, which carries two pump impellers 7. The pump inlet is indicated by means of the reference numeral 9 and the pump outlet is indicated by means of the reference numeral 10.

For the electric motor 3, 4 there is provided a lubrication/cooling circuit having an external cooler 11 which is connected to the motor through line 12, connected to the motor at connecting piece 13 on the pressure shell 2, and a line 14, which runs to the other end of the electric motor.

There is a lubricant/coolant impeller 15 on the motor shaft 3. This impeller 15 sends lubricant/coolant out through the connecting piece 13, through the line 12, the cooler 11 exposed to the surrounding seawater (the pump module 1 is a subsea device) and back to the motor through the line 14. The bearings for the motor shaft 3 are indicated by means of reference numerals 16 and 17 respectively. The lubricant/coolant flows in a known way through the whole motor.

The lubrication/cooling circuit 12, 11, 14 is connected to the inlet line 18 of the pump at 19, via a diaphragm chamber 20, containing a pretensioned separating diaphragm 21. As shown, a line 22 runs from the diaphragm chamber 20 to the space around the flexible connection 5, for pressure balancing.

A line 23 runs from the high-pressure end of the pump to the inlet line 18 of the pump, at 19. A line 24, connected to the line 23, runs from the end of the pump shaft 6

The lubrication/cooling circuit will be pressure-impacted by the fluid pressure at the inlet of the pump via the separating diaphragm 21. Pressure application via the separating diaphragm 21 ensures a balancing of pressure, with a small pressure difference from the motor towards the pump via the bearings 25, 26 and a mechanical seal 27. The pressure difference is caused in that the pressure, as mentioned above in connection with FIG. 1, falls in the pump inlet when the pump is running, and in that there is an impeller function in/at the seal 27.

Figure 3:
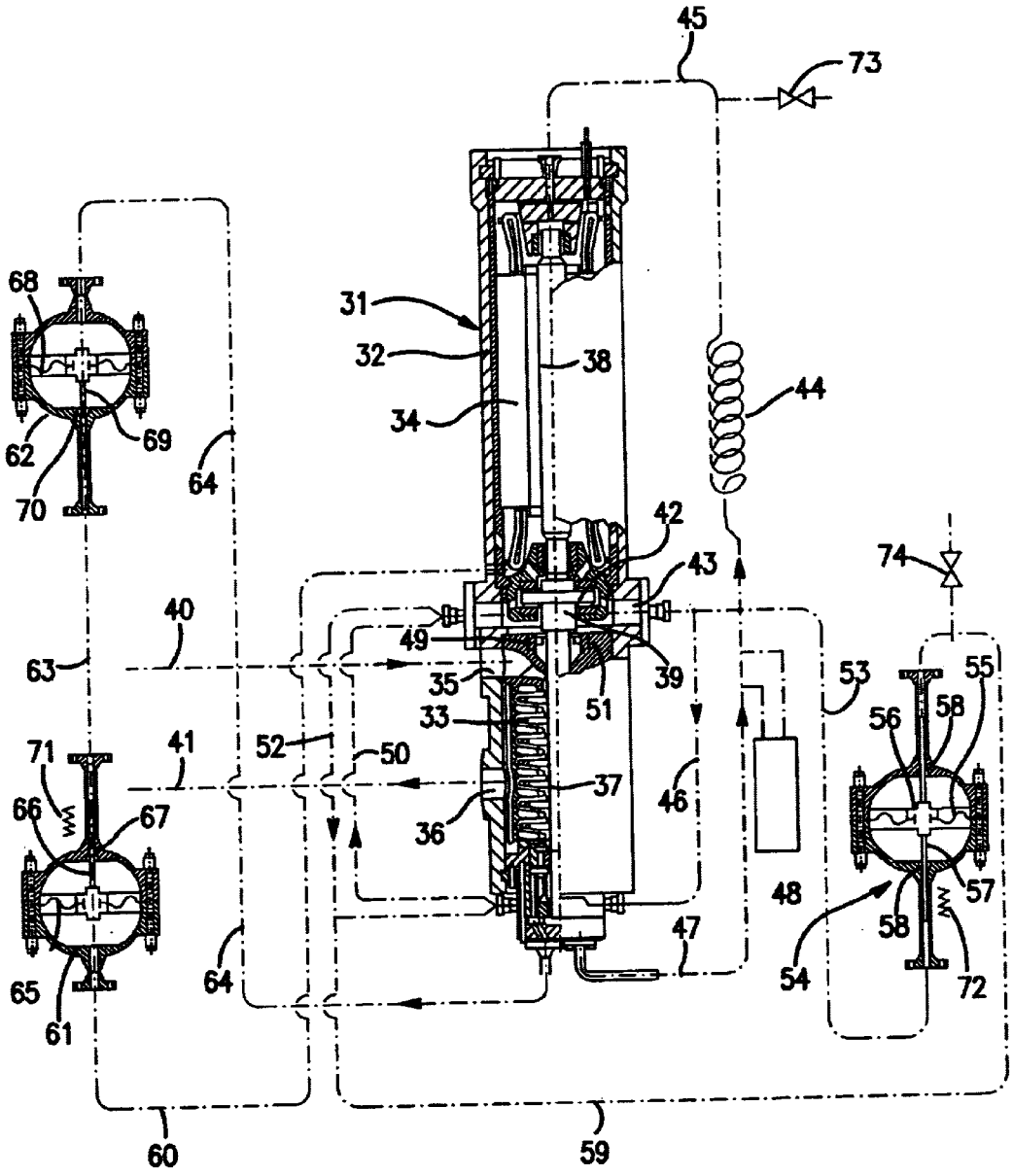
FIG. 3 is a purely schematic partially cutaway view of a subsea pump module having a device according to the invention.

The system shown in FIG. 3 includes a pump module 31 which has a pump and a pump motor in a common pressure shell 32. The pressure shell 32 is in this case in the form of a substantially cylindrical body with open ends and an inner through passageway between these ends. The passageway is designed and sized to slidably and snugly receive respectively a pump insert 33 and an electric pump motor 34 from a respective end. The substantially cylindrical pressure shell 32 has a casing having two openings 35, 36 associated with respectively an inlet and an outlet in the pump insert. The pump insert inlet is arranged at the end of the pump insert 33 facing the pump motor 34.

The illustrated pump insert 33 is a centrifugal pump, with a rotor or pump shaft 37, whilst the pump motor 34 is, as mentioned, an electromotor, with a drive shaft 38. The motor shaft and the pump shaft are drive-connected at 39 in a manner not shown in more detail.

The pump module 31 shown in FIG. 3 is intended for use as a water pump and is connected to a water inlet line 40 and a water outlet line 41 at the inlet 35 and the outlet 36 respectively.

The illustrated pump module 31 has a unique lubricating and cooling system which will now be explained in more detail. The inner space of the motor housing 32 is part of a bearing lubrication and motor cooling circuit, and the flange of a thrust bearing is, in a manner not shown in detail, made in the form of an impeller 42 which, when the motor is running, will pump lubricant from the inner space of the motor out through the outlet 43 and through an external cooler 44 and from there through a line 45 back to the other end of the motor space. Here, some of the lubricant will pass through the bearing at hand and then through the motor space to the other motor bearing and back to the impeller 42. The rest of the lubricant will spread radially and cool the end windings in the motor.

A separate lubricant-carrying line 46, which opens out between a mechanical seal and the bearing, runs to the pump shaft bearing at the high-pressure end of the shaft. A lubricant-carrying line 47 runs from the outside of the bearing to the area of connection between the passageway 43, the cooler 44 and the line 46, thus forming a circulation circuit for lubricant to the bearing at the high-pressure end. The circulation in the circuit formed by the lines 46, 47 is supported by a non-illustrated impeller formed by the pump It should be mentioned that the main impeller 42 and the non-illustrated impeller at the high-pressure shaft end are elements which will be well-known to the skilled person, and such impellers can be made using simple means, for example, with the aid of radial drilled holes in the flange 42 and small blade cut-outs on the end of the shaft 37.

As shown, the line 47 is connected to a separator 48 for separating water which might have infiltrated into the lubricant. This water separator 48 may be made in the form of a sump where water can be deposited.

At each end, the pump has a known double mechanical seal. A separate circulation circuit is provided for lubricating these two double mechanical seals. The mechanical seal on the low-pressure side has an inlet 49, only schematically indicated, which is connected to an external circulation line 50, and an outlet 51, also only schematically indicated, which is connected to an external circulation line 52. Similarly, a mechanical seal arranged in the high-pressure end has an inlet and an outlet (not shown) connected to the lines 52 and 50 respectively. This lubrication circuit for the seals has a separate circulation which is provided by pump rings incorporated in the mechanical seals, in a known way per se.

When in operation, the seal lubrication circuit 50, 52 has slightly lower pressure than the bearing lubrication and motor cooling circuit, because it is connected to this circuit through a line 53 and a separating diaphragm means 54. The separating diaphragm means 54 consists essentially of two hemispherical shells that are bolted together with a rolling diaphragm 55 fixed between them. The rolling diaphragm 55 is weight-loaded 56 and has a control rod 57 which passes through the seals 58 in the two hemispherical shells. The control rod 57 is in a manner not shown in detail made in the form of a damper piston, intended for interaction with the seals 58 if the diaphragm should sink to the bottom of the vessel formed by the spherical shells. The weight load 56 and the impeller function in/at the mechanical seal in the ends of the pump will be instrumental in providing the said lower pressure in the line 59 and thus in the circulation lines 50, 52.

The pressure load of the lubrication/cooling circuit is provided via a line 60 from the circuit, in the embodiment in FIG. 2, from the inner space of the motor. The line 60 is connected to the inlet end 40 of the pump via a pressure compensation arrangement that comprises two diaphragm separating means 61, 62 having a weight column 63 connected therebetween, and a line 64 from the upper of the two diaphragm separating means. A balance line 64 runs from the pressure or discharge side of the pump to the inlet or suction side.

The lower diaphragm separating means 61 comprises a rolling diaphragm 65 fixed in a two-part vessel and having a damper piston/control rod 66 which passes through a seal 67. The upper separating diaphragm means 62 also has a rolling diaphragm 68 fixed in a two-part vessel and a damper piston/control rod 69 running through a suitable seal 70.

Any liquid loss in the cooling circuit and the seal circuit can be detected by reading the position of the respective control rod with the aid of an external level gauge 71 and 72 respectively. Each control rod 66, 57 may, for example, have a magnetic or radioactive device for this purpose.

A pipe 63 runs between the two separating diaphragm means 61, 62. In the embodiment in FIG. 3, this pipe 63 is filled with an inert oil having a density that is considerably greater than that of the pump medium (water). As an example, the density of water is about 1000 kg/m$^3$, so as inert oil in the pipe 63, it would be advantageous to use an oil which has a density of about 2000 kg/m$^3$. The lubricant has, for example, a density of 870 kg/m$^3$. Needless to say, heavy media and lubricants other than oil may be used.

If, for example, there is a pressure of 90 bar in the pump inlet 35 and a pressure in the pump outlet 36 of 140 bar, the illustrated and described system will be able to operate with a pressure on the diaphragm 68 of just below 90 bar. The pressure on the diaphragm 65, in the lower separating diaphragm means 61, will be just above 90 bar. When the motor shaft 38 runs at 3600 rpm, there will, for example, be a pressure of about 97 bar in the outlet 43 associated with the impeller 42. As a consequence of the connection to the lubrication/cooling circuit via the diaphragm separating means 54, the prevailing pressure in the seal lubrication circuit (the lines 50, 52) will be slightly lower under running conditions, about 96 bar.

When the pump module 31 has been installed, the interior of the pump will have contact with the surrounding pressure via inlet 35 and outlet 36. This means that the motor and the lubricant circuits are pressure-balanced against the surroundings. The inert oil system (the line 63) will ensure that there is always a slight overpressure towards the pump, i.e., across the mechanical seals at the drive end of the pump.

When the pump module is stationary, where the pump module 31 is connected to inlet and outlet lines, there are similar pressure conditions. The motor and the lubricant circuits are pressure-balanced against the process system, i.e., the inlet and outlet lines. The compensation system with the liquid column of inert oil in the pipe 63 will ensure that there is always a slight overpressure towards the pump.

When the pump module is pumping, and the motor is running, the pump will be pressurised in conformity with the pump inlet pressure. The main impeller 42 will increase the pressure towards the mechanical seals in the pump and circulate the lubricant (oil) through the cooler 44 and back to the motor, i.e., the inner space of the motor.

The pump bearing at the high-pressure side of the pump is supplied with lubricant by means of the action that the pump shaft end produces, since, as mentioned, this shaft end is made in the form of an impeller.

The lubrication circuit for the seals will have a pressure that is lower than the pressure around the mechanical seal at the ends of the pump. This is due to the effect of the impeller function in/at the mechanical seal and the compensator system including the separating diaphragm means 54.

Refilling the lubrication/cooling system can take place with the aid of two valves 73, 74. Refilling can take place through these valves from an external source, for example, an oil-filled pressure tank connected to the pump module or a so-called umbilical from a platform.

The pump medium, in the embodiment in FIG. 3 water, in particular so-called produced water, will in the event of a leak in the diaphragm 68 be unable to penetrate through or mix with the inert oil in the pipe 63.

In the event of a leak in the diaphragm 65 arranged closest to the motor, the inert oil will penetrate into the lowermost part of the line 60 which runs to the motor. An appropriate dimensioning of this line will prevent the inert oil from penetrating into the motor.

A leak in the diaphragm 55 in the separating diaphragm means 54 will cause a slight increase of pressure, accompanied by increased leakage. Loss of this barrier might mean that the motor is contaminated with water. This can only happen if water leaks past the seal facing the pump medium. This will normally only happen in the event of adverse pressure transients or substantial damage to the seal. If water infiltrates into the lubrication/cooling circuit of the motor, the water separator 48 will effect a change of such water. The water separator, made in the form of a simple sump, should have a capacity of several litres. Water that is collected in the water separator will not have any consequences for the operation of the pump module.

Leaks through the seals will call for refilling, but this has no negative consequences as long as the refilling system is dimensioned and designed for such refilling. Leaks inside the seals will result in a need for refilling in the seal lubrication circuit. This will not have any effect on the operation of the pump module as long as the refilling system (through the valves 74) is dimensioned and designed for necessary refilling. Seals of this type always have a normal leakage that is very small. What is special about the arrangement in this case is that the buffer medium which circulates between the seals is continuously replaced in that it leaks into the pump whilst the motor medium always leaks into the buffer circuit.

Normally, the buffer medium leaks in both directions. If the buffer medium has been contaminated with water, it will also leak into the motor.

Figure 4:
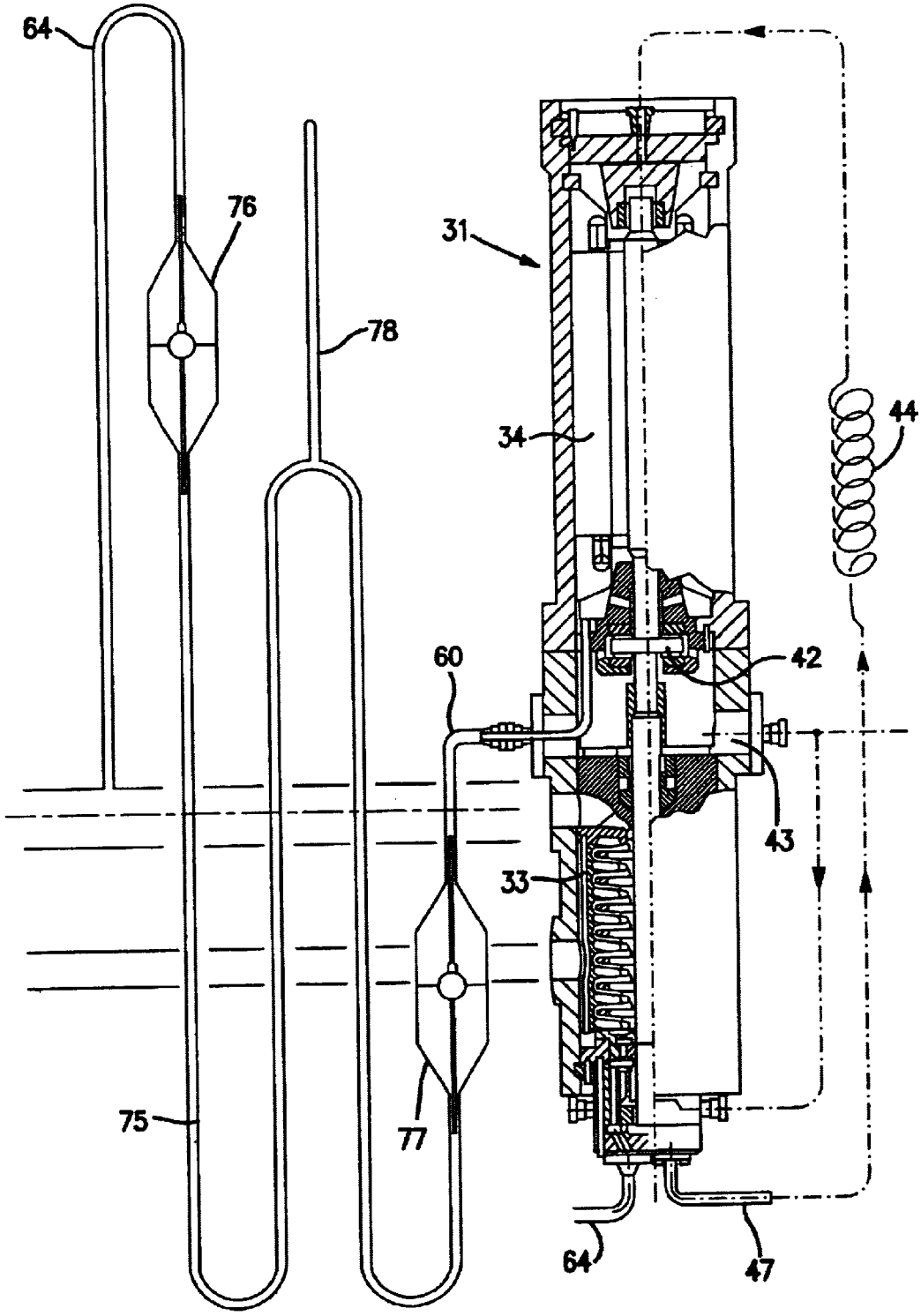
FIG. 4 shows a variant of the weight load system in the device according to the invention.

FIG. 4 shows another possible design of the weight load system in the lubrication/cooling circuit. In FIG. 4 only the actual pump module and the weight load system are shown. The same reference numerals are used as in FIG. 3 for the same components. In the embodiment shown in FIG. 4, between line 64 and line 60 a length of pipe 75 has been installed between two float valves 76 and 77. In this length of pipe 75 there is provided a heavy medium which thus separates the motor coolant (in the line 60) from the pumped medium (in line 64). As both the motor coolant and the pump medium are lighter than the heavy medium in the length of pipe 75, they will float on the top. In the length of pipe 75 there is provided a gas and liquid trap 78 approximately halfway along the length of pipe 75.

Figure 5:
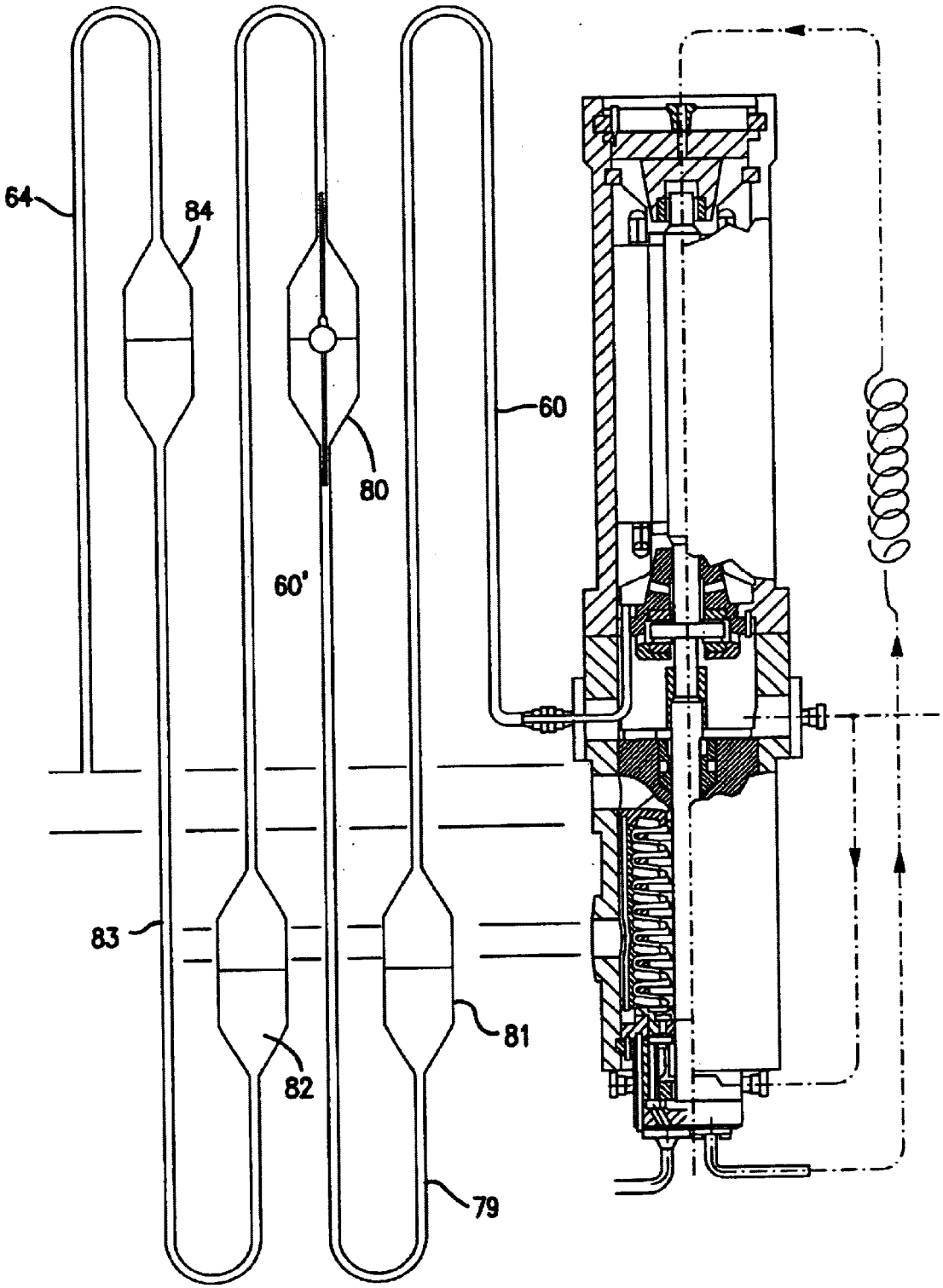
FIG. 5 shows another variant of the weight load system in the device according to the invention.

FIG. 5 shows yet another variant of the weight load system. Here too, only the actual subsea device (the pump module) with the weight load system are shown, and the same reference numerals are used as in FIG. 3 for the same components.

In the embodiment in FIG. 5, between the line 64, which carries pump medium, and the line 60, which carries coolant, a length of pipe 79 has been installed which has a float valve 80 arranged approximately halfway. In the line 60 there is coolant/lubricant all the way up to a vessel 81. The length of piping going out from the upper end of the float 80 is filled with coolant all the way up to a second vessel 82. From there the length of pipe 83 is filled with a heavy medium, up to a third vessel 84.

The level of liquid in each of the vessels 81, 82, 84 is indicated by means of a transverse line. The heavy medium in all three embodiments in FIGS. 3, 4 and 5 is inert liquid which does not react with either the coolant or the pump medium.

Figure 6:
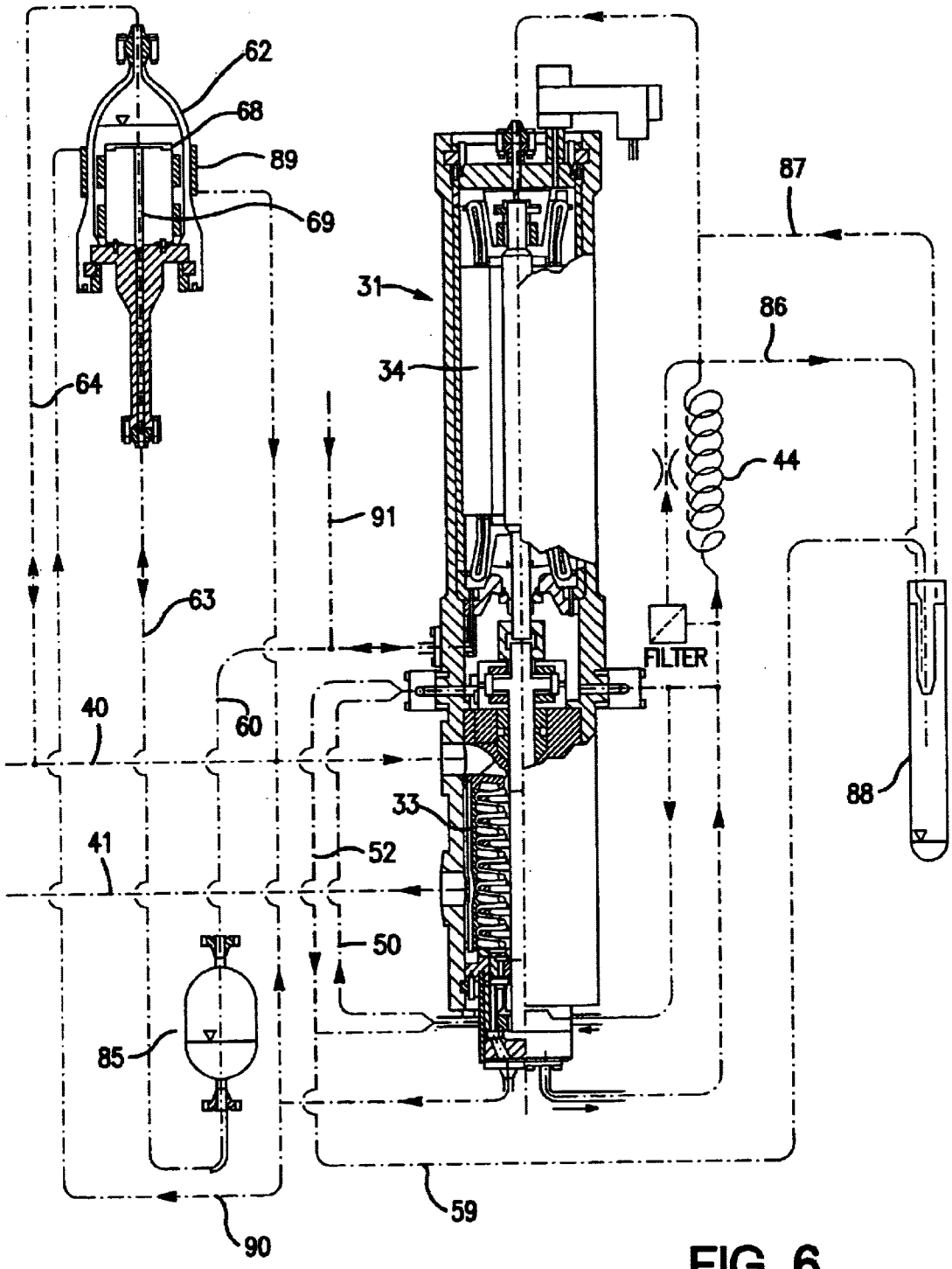
FIG. 6 is another partially cutaway view of a subsea pump module having a device according to the invention.

FIG. 6 shows yet another variant of the invention. Here too, the same reference numerals as those used in FIG. 3 are used for the same components.

In contrast to the embodiment in FIG. 3, instead of the lower diaphragm separating means 61, a vessel 85 is used where the heavy medium in the line 63 and the lubricant/coolant in the line 60 meet.

In the embodiment in FIG. 6 the diaphragm means 54 from the embodiment in FIG. 3 has been omitted. Instead the reference pressure is taken out after (or at a point on) the cooler 44, as shown by the lines 86 and 87, and the refilling line 59 is connected via a separator 88. In the separator 88 water is separated out. The arrangement is such that there is a slightly lower pressure in the line 59, so that the water can be sucked up from the separator 88 through the line 59. Water that is sucked in through the line 59 will disappear in the pump. This gives a continuous cleaning of the system.

It may be desirable to have a local increase in pressure at the seals in the pump with the aid of an impeller (not shown).

The diaphragm separating means 62 is provided with a heat exchanger 89. Heat comes from a branch 90 of the drainage pipe 65. The water there will be a few degrees hotter than the temperature in the inlet line 40 because of hydraulic loss in the pump 33.

In a pump medium containing hydrocarbons there is often the possibility of the deposit of waxy substances. An increased temperature reduces or prevents this.

It is advantageous to insulate the diaphragm separating means 62 against the sea in order to prevent great heat loss. Such insulation is not shown.

The diaphragm separating means is filled with an inert oil having high specific gravity. The oil may, for example, be a silicone fluid. The requirement for this medium is that it has a considerably higher specific gravity than the pumped medium and the substances this medium contains, and will be capable of being deposited in the diaphragm separating means 62. The medium must also be inert to these. This provides an extra barrier against the coolant/lubricant and also ensures that deposits do not block the diaphragm movement, but will float on top of the inert medium.

The refilling of the system in FIG. 5 can be carried out through the line 91.

In the embodiment in FIGS. 3 to 6 liquid columns are used as weight loads. In principle, the same effect can be achieved by weighting down the diaphragms. Pretensioned diaphragms are also a possibility. However, it is preferable to use a heavy inert medium because this gives the advantage that there is an extra barrier which will be virtually unaffected in the event of a leak.

The invention is not limited to the illustrated design of the pump module. Thus, the invention is generally useful for all subsea devices which have an electric machine and a fluid machine drive-connected thereto.

What is claimed is:

1. A device for use with a subsea pump module (1) including a housing, a pump (6, 7) disposed in the housing and having a pump inlet (9) and a pump outlet (10), a pump shaft (6) with mechanical seals (27) and bearings (25, 26) for supporting the pump shaft (6) in the housing, an electric pump motor (4) arranged in the housing and having a motor shaft (3) drive-connected to the pump shaft, which pump module (1) has a motor pump (4) lubrication and cooling circuit (2, 11, 14) exposed to the surrounding seawater, and where the said pump inlet (9) is at the side of the pump that is adjacent to the pump motor (4), characterised in that the lubrication and cooling circuit (2, 11, 14) is pressure-impacted by the pump medium pressure in front of the pump inlet (9) via a separating means (21) pretensioned towards the pump motor, and that an impeller (27) is arranged on the pump shaft (6) in the end adjacent to the pump inlet (9).

2. A device according to claim 1, characterised in that the separating means is a separating diaphragm (21).

3. A device according to claim 1, characterised in that the lubrications and cooling circuit is pressure-impacted by said fluid pressure via a weight load (63).

4. A device according to claim 3, characterised in that the weight load is in the form of a liquid column (63).

5. A device for use with a subsea pump module (1) comprising:

a housing;

a pump (6, 7) disposed in the housing and having a pump inlet (9) and a pump outlet (10), a pump shaft (6) with mechanical seals (27) and bearings (25, 26) supporting the pump shaft (6) in the housing;

an electric pump motor (4) arranged in the housing and having a motor shaft (3) drive-connected to the pump shaft; and a motor pump (4) lubrication and cooling circuit (2, 11, 14) exposed to the surrounding seawater, wherein, the pump inlet (9) is at the side of the pump that is adjacent to the pump motor (4), the lubrication and cooling circuit (2, 11, 14) is pressure-impacted by the pump medium pressure in front of the pump inlet (9) via a separating means (21) pretensioned towards the pump motor, an impeller (27) is arranged on the pump shaft (6) in the end adjacent to the pump inlet (9), the lubrication and cooling circuit is pressure-impacted by said fluid pressure via a weight load (63), the weight load is in the form of a liquid column (63), and the liquid column (63) is arranged between the upper and lower separating diaphragm means (62, 61).

6. A device according to claim 5, characterised in that each individual separating diaphragm (68, 65) is provided with a respective damper piston (69, 66).

7. A device according to claim 4, characterised in that the liquid column (75) is separated from the pump medium and from the lubricants and coolant in the lubrication and cooling circuit (60) by a respective float valve (76, 77).

8. A device according to claim 4, characterised in that the liquid column is split into two liquid columns (83, 79) which are separated from one another by a lubricant and coolant column (60'), which is bounded at one of the liquid columns (79) by a float valve (80).

9. A device according to claim 1, further comprising a seal lubrication circuit (50, 52) for the pump (33).

10. A device according to claim 9, characterised in that the seal lubrication circuit (50, 52) is connected to the lubrication and cooling circuit in such manner that the seal lubrication circuit (50, 52) has a lower pressure than the lubrication and cooling circuit, but a higher pressure than the said fluid pressure.

11. A device according to claim 10, characterised in that the seal lubrication circuit (50, 52) is connected to the lubrication and cooling circuit after or at a point in the external cooler (44) through a separator (88) for separating water from the lubricant and coolant.

12. A device according to claim 10, characterised in that the seal lubrication circuit (50, 52) is connected to the lubrication and cooling circuit via a separating diaphragm (55) which is weight-loaded (56) towards the lubrication and cooling circuit.

13. A device for use with a subsea pump module (1), comprising:

a housing;

a pump (6, 7) disposed in the housing and having a pump inlet (9) and a pump outlet (10), a pump shaft (6) with mechanical seals (27) and bearings (25, 26) for supporting the pump shaft (6) in the housing;

an electric pump motor (4) arranged in the housing and having a motor shaft (3) drive-connected to the pump shaft, which pump module (1) has a motor pump (4) lubrication and cooling circuit (2, 11, 14) exposed to the surrounding seawater, wherein, the pump inlet (9) is at the side of the pump that is adjacent to the pump motor (4), the lubrication and cooling circuit (2, 11, 14) is pressure-impacted by the pump medium pressure in front of the pump inlet (9) via a separating means (21) pretensioned towards the pump motor, an impeller (27) is arranged on the pump shaft (6) in the end adjacent to the pump inlet (9), the separating means is a separating diaphragm (21), and each individual separating diaphragm is associated with a level sensor (71, 72).

14. A device according to claim 13, characterised in that the lubrication and cooling circuit includes an impeller (42) in the electric motor.

* * * * *